United States Patent [19]

Bright

[11] 4,431,064

[45] Feb. 14, 1984

[54] HYDRAULIC DRIVE APPARATUS FOR DOWNHOLE TOOLS PROVIDING ROTATIONAL AND TRANSLATIONAL MOTION

[75] Inventor: Gary R. Bright, Tulsa, Okla.

[73] Assignee: Standard Oil Company (Indiana), Chicago, Ill.

[21] Appl. No.: 318,476

[22] Filed: Nov. 5, 1981

[51] Int. Cl.[3] ..... E21B 4/02

[52] U.S. Cl. ..... 175/93; 175/94; 60/464; 60/484

[58] Field of Search ..... 60/420, 423, 427, 464, 60/484; 173/8, 9; 175/93, 94, 122, 162, 202, 203, 267, 26

[56] References Cited

U.S. PATENT DOCUMENTS 4,149,380 4/1979 Nonnenmacher ..... 60/464
4,275,793 6/1981 Schivley, Jr. et al. ..... 173/9
4,356,871 11/1982 Fujikawa ..... 173/8

FOREIGN PATENT DOCUMENTS 595504 2/1978 U.S.S.R. ..... 173/8

*Primary Examiner*—Stephen J. Novosad
*Assistant Examiner*—William P. Neuder
*Attorney, Agent, or Firm*—Lansing M. Hinrichs; William T. McClain; William H. Magidson

[57] ABSTRACT

An hydraulic drive apparatus for use in downhole tools is described. The apparatus provides rotational and translational movement to a cutting tool element disposed in a downhole tool or sonde automatically adjusting advancing motion of the cutting tool to the rate of rotational movement or cutting. The apparatus is controllable from the surface through a wireline and is capable of operating in various modes to facilitate unjamming.

4 Claims, 5 Drawing Figures

FIG. 1
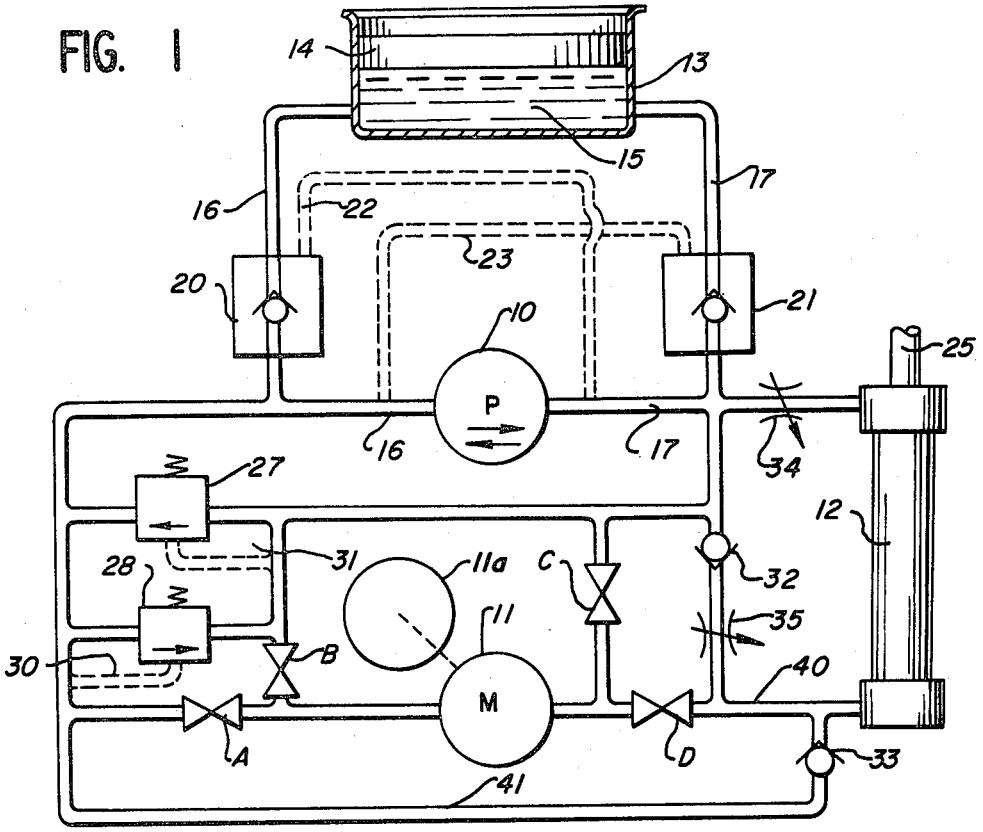
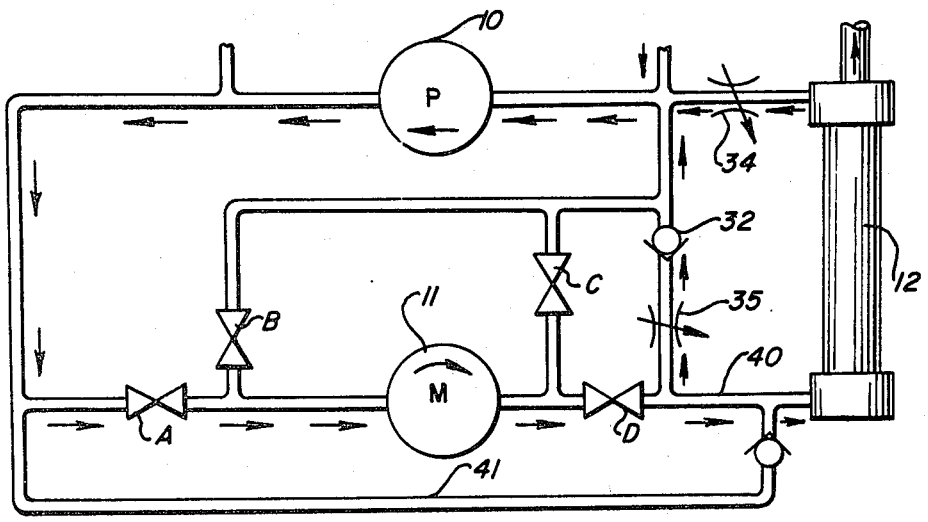
FIG. 2

HYDRAULIC DRIVE APPARATUS FOR DOWNHOLE TOOLS PROVIDING ROTATIONAL AND TRANSLATIONAL MOTION

BACKGROUND OF THE INVENTION

In geological exploration or production activities it is frequently desired to utilize rotatable tool elements such as saws, drills and core sampling devices within a bore hole at a considerable distance beneath the surface. The rotatable tool element is usually carried within a sonde or downhole tool and is lowered into the bore hole on the end of a wireline having electrical conductors capable of transmitting electric power to the tool element. When such tool elements are operated in directions perpendicular to the axis of the bore hole and jam while in an extended position, a very serious problem exists. If the jam cannot be cleared and the cutting tool retracted, the downhole tool or sonde cannot be withdrawn from the bore hole without serious damage of destruction.

To be effective a rotatable tool element must not only be rotated but must also be advanced into the material to be cut, drilled or sampled at a rate consistent with the ability of the tool to remove material. The rate of removal of the material varies with the hardness of the material and the condition of the cutting elements. Accordingly, an important object of this invention is to provide an hydraulic apparatus for providing both rotational and translational motion to a tool element, the rate of translational advance of the tool element being automatically maintained to be consistent with the rate of removal of material by the rotating tool element.

When a rotatable tool becomes jammed it ceases to rotate and no longer serves to remove material or rotates so slowly as to be ineffective. When so jammed the tool is usually in an extended position and must be first retracted so that the downhole tool or sonde may be withdrawn from or otherwise moved in the bore hole. The following three modes of unjamming the tool are available:

(1) Discontinue the supply of power for rotating the tool element and apply all available power to retraction thereof.

(2) Continue to supply power for rotation of the tool element in the forward cutting direction and, additionally, supply power for retracting the tool element.

(3) Supply power for rotation of the tool element in the reverse direction and, additionally, supply power for retracting the tool element.

If one of the above modes of unjamming is ineffective either or both of the others can be effective. Moreover, in some cases repeated application of the several modes in different order can be effective. Accordingly, a second important object of this invention is to provide a tool element driving apparatus controllable from the surface for selectively applying any one of the above-described modes of unjamming to a tool disposed in a bore hole.

Another object of this invention is to obtain maximum utilization of the conductors available in a wireline for powering the downhole tool with only a single conductor being required for control purposes in selection of the mode of operation. In a conventional seven conductor wireline this leaves six conductors available for supplying electrical power to the rotating tool and, when the significant IR drop involved when the downhole tool is suspended in very deep bore holes is taken into consideration, this feature is quite significant.

Other objects and advantages of this invention will be apparent to those familiar with the art on reading the following description of the invention.

SUMMARY OF THE INVENTION

The hydraulic drive apparatus of this invention for use in downhole tools comprises:

(a) an electric motor driven pump;

(b) a positive displacement hydraulic motor connected by conduit means to the pump and adapted to be driven thereby;

(c) a cutting tool element capable of rotational and translational movement and connected to the hydraulic motor so as to be rotationally drive thereby;

(d) an hydraulic piston interconnected to the cutting tool element so as to impart translational movement thereto as the hydraulic piston is moved; and (e) conduit means interconnecting the outlet of said hydraulic motor to the hydraulic piston whereby translational advancing movement of the cutting tool element is imparted thereto at a rate which varies with the rate of rotational movement of the cutting tool.

In a preferred embodiment means are provided at the surface for reversing the direction of the motor driven pump and a check valve means is provided to prevent fluid exiting from the pump from driving the hydraulic motor, the exiting fluid instead being conducted to the hydraulic piston to impart retracting movement thereto and to the cutting tool element.

In order for the apparatus to be operatable within a deep bore hole a reservoir for hydraulic fluid is provided, and the fluid in this reservoir which is connected by conduit means to the two sides of the pump is subject to ambient bore hole pressure so that the hydraulic drive apparatus operates at an incremental pressure above bore hole pressure. To permit the supply of hydraulic fluid from the reservoir to the pump and to provide for adjustment of hydraulic fluid pressure within the apparatus to changes in bore hole pressure as the tool is raised or lowered, a pair of pilot operated check valves are provided in the conduits interconnecting the reservior with the two sides of the pump.

BRIEF DESCRIPTION OF THE DRAWINGS

FIG. 1 is a diagram of a preferred embodiment of the hydraulic drive apparatus of this invention;

FIG. 2 is a diagram illustrating the direction of flow of hydraulic fluid through the apparatus in normal operation with the tool element both rotating and advancing;

In FIGS. 2–5 certain elements of the hydraulic apparatus have not been shown in order to more clearly show the hydraulic flow paths for driving the tool.

DETAILED DESCRIPTION OF THE INVENTION

Figure 3:
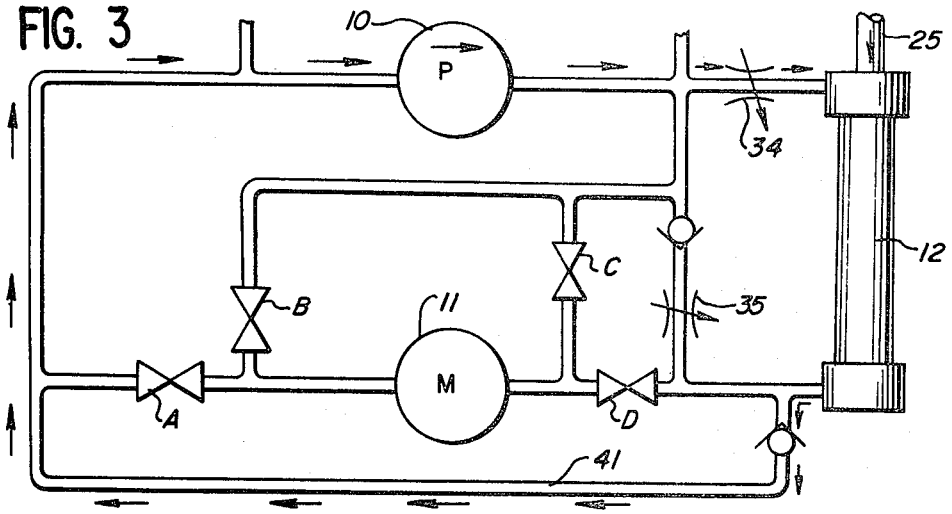
FIG. 3 is a diagram illustrating the direction of flow of hydraulic fluid through the apparatus when the pump is reversed, the tool element is not rotating and full power is applied to retract the tool element.

The hydraulic drive system apparatus of a preferred embodiment of this invention is illustrated in FIG. 1. The major elements of the system include a positive displacement pump 10 adapted to be driven in either direction by an electric motor (not shown) an hydraulic motor 11 which is also positive displacement type, an hydraulic cylinder 12, and a reservoir 13. In addition to these elements the system includes interconnecting conduits and appropriate valves.

Since the system of apparatus must be operable within a bore hole which can be filled with drilling mud or other fluid, the reservoir 13 is provided with a piston 14, or alternatively a diaphragm, which serves to separate the hydraulic fluid indicated at 15 from the bore hole fluid whose pressure is exerted against the piston 14 or diaphragm. Thus the hydraulic system operates at ambient bore hole pressure and the elements thereof need not be constructed in order to resist bore hole pressure which at a depth of around twenty thousand feet can be in the neighborhood of ten thousand pounds per square inch. Bore hole conditions also dictate the choice of the hydraulic fluid for temperatures ranging as high as about 250° F. can be encountered. The following fluids are satisfactory:

Dow Corning Silicone Hydraulic Fluid Type 560

Autoline Hydraulic Oils Company E P Anti-Wear Hydraulic Oil

Both sides of pump 10 are connected by conduits 16 and 17 through pilot operated check valves 20 and 21. Control conduits 22 and 23 for operating these valves are cross connected to opposite sides of the pump 10 in order to open the appropriate check valve on the suction sides of the pump 10 and supply any required make-up fluid from reservoir 13. Valves 20 and 21 also serve to adjust system pressure to bore hole pressure as bore hole pressure is varied, for example, when the tool is raised or lowered in the bore hole. Upon lowering the tool valves 20 and 21 serving as check valves open to admit fluid from the reservoir 13 to the system increasing its pressure to ambient bore hole pressure. Upon raising of the tool in the bore hole the pilot control through conduits 22 and 23 opens valves 20 and 21 when system pressure exceeds bore hole pressure to relieve system pressure.

Hydraulic motor 11 is operatively connected to the rotary tool 11*a* which may be a drill, saw or coring cutter, for example, in any conventional manner. The hydraulic drive apparatus of this invention is particularly suited for supplying rotational and translational movement to the Apparatus for Drilling into the Sidewall of a Drill Hole described and claimed in U.S. Pat. application Ser. No. 051,485 filed June 25, 1979 by Alfred H. Jageler et al. and assigned to the assignee of the present application. The aforesaid Jageler el al. application is hereby incorporated herein by reference. Jageler et al. prefer to utilize two separate hydraulic systems for the tool element, one for rotation thereof and the other for advancing and retracting.

In the present invention both rotational and translational movement of the cutting tool element 11*a* are provided by a single hydraulic system. To effect translational movement the rotary tool element (not shown) is also operatively connected to a piston 25 operating within hydraulic cylinder 12. Thus movement of piston 25 serves to advance or retract the cutting tool element. In order to protect the system when the piston 25 is fully advanced or fully retracted a pair of pressure relief valves 27 and 28 (FIG. 1) are provided. These valves are pilot controlled through control conduits 30 and 31 and are set so as to open the corresponding valve when a predetermined maximum differential pressure above bore hole pressure is encountered. Valves 27 and 28 are also operable to protect the system in the even for any reason the rotary tool cannot be advanced or retracted.

The preferred system of apparatus also includes two conventional check valves 32 and 33, two throttling valves 34 and 35 and four function control valves A, B, C and D. The four function control valves can be preset at the surface or can be set from the surface by remote control to be in either open or closed position according to the function it is desired to perform. These valves can be solenoid operated, a conventional multiplexer being installed in the downhole tool to operate each valve in response to a predetermined signal transmitted down the wireline from the surface. Alternatively, the four valves may be formed in a single block having a rotating cylinder valve element setable in appropriate positions corresponding to the modes of operation. In the latter case solenoid means are provided for moving the valve element from one position to the next in response to electrical pulses sent down the wireline. It should be noted that only three valve setting positions are required since the valve settings in Mode I and Mode II operations described later can be the same.

In addition to the control valve settings, control of the operational mode is determined by the direction the hydraulic pump 10 is driven. This pump is preferably driven by a direct current motor of such type that its direction of rotation can be changed by reversing the electrical connections to the power supply at the surface. In Mode I operation (see FIG. 2) the pump 10 is driven in such direction as to withdraw hydraulic fluid from conduit 17 forcing it under pressure into conduit 16. In Modes II, III and IV the pump runs in the opposite direction to force fluid into conduit 17. Control valve settings for the several modes and the resulting operations of the rotating tool element are as follows:

Mode I—valves B and C closed A and D open. Tool rotates clockwise and advances.

Mode II—valves B and C closed A and D may be opened or closed. Tool not rotating and retracts.

Mode III—valves A and C closed B and D open. Tool rotates clockwise and retracts.

Mode IV—valves B and D closed A and C open. Tool rotates counterclockwise and retracts.

As used herein the relative terms advance and retract and clockwise and counterclockwise are employed merely to indicate opposite directions. As will be obvious to those familiar with the art depending upon gearing arrangements or linkages employed, opposite directions of motor rotation or piston movement can readily be achieved.

The hydraulic fluid flow which is obtained in each of the four modes is indicated by arrows in FIGS. 2–5. For simplicity the reservoir 13 and its associated valves and the pressure relief valves have not been shown in these figures.

The throttling valves 34 and 35 are utilized to control the relative flow of hydraulic fluid to cylinder 12 and accordingly the rate of movement of piston 25 to advance the rotating tool element, particularly when operating in Mode I whose flow pattern is illustrated in FIG. 2. As will be apparent when valve 35 is open wide and valve 34 is nearly closed a large proportion of fluid passing through the hydraulic motor 11 will pass through valve 35 and check valve 32 bypassing cylinder 12. Thus the rate of movement of piston 25 will be slow. Opening valve 34 and closing down valve 35 diverts more flow through conduit 40 and produces greater movement of piston 25. In practice valves 34 and 35 are preset when the downhole tool or sonde is at the surface for the desired relative rate of cutting tool advance. Tool advance, however, is also controlled by the rate of which positive displacement drive motor 11 turns. As this motor slows the fluid flow lessens and the throttling effects of valves 34 and 35 become minimal reducing or checking advance of the rotating tool. This feature tends to prevent stalling or jamming of the rotating tool which in turn speeds up as material is cut away with increasing fluid flow restoring the rate of advance of the tool to a higher level. In this manner the rate of advance of the cutting tool is automatically adjusted to the cutting speed of the rotating tool element.

Normal operation of the hydraulic system of this invention is conducted in Mode I and upon completion of a satisfactory cutting operation the polarity of the leads in the wireline connected to the electric motor in the sonde is reversed to reverse the motor and the direction of pump 10. The fluid flow pattern is then as shown in FIG. 3 and Mode II operation is achieved. Motor 11 is not driven but piston 25 is moved by fluid entering cylinder 12 through valve 34 to retract the cutting tool. In this Mode II valves A and D can be open or closed for fluid leaving cylinder 12 can readily pass through check valve and conduit 41 back to the pump 10. In this mode it should be noted that the full power of pump 10 is exerted upon the piston 25.

Figure 4:
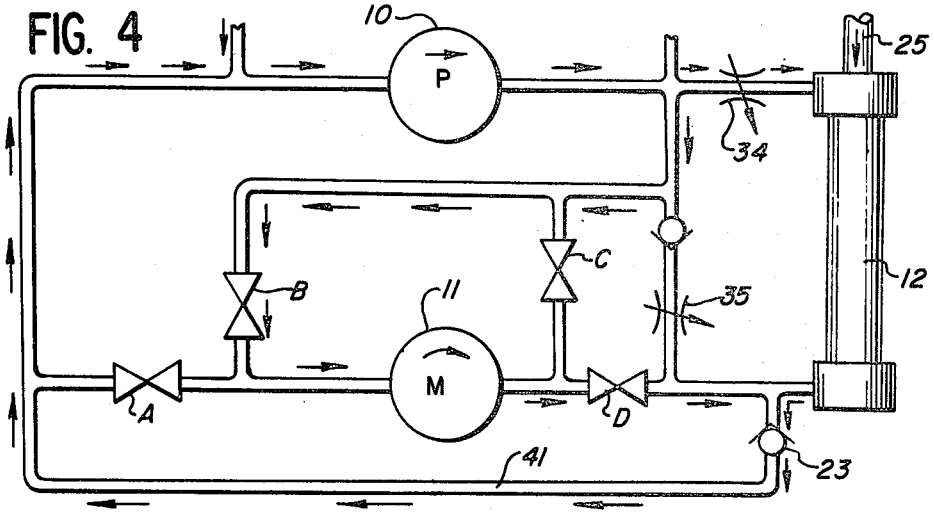
FIG. 4 is a diagram illustrating the direction of flow of hydraulic fluid when the control valves are set so that the tool element is rotated in the same direction as in FIG. 2 and is simultaneously retracted.
Figure 5:
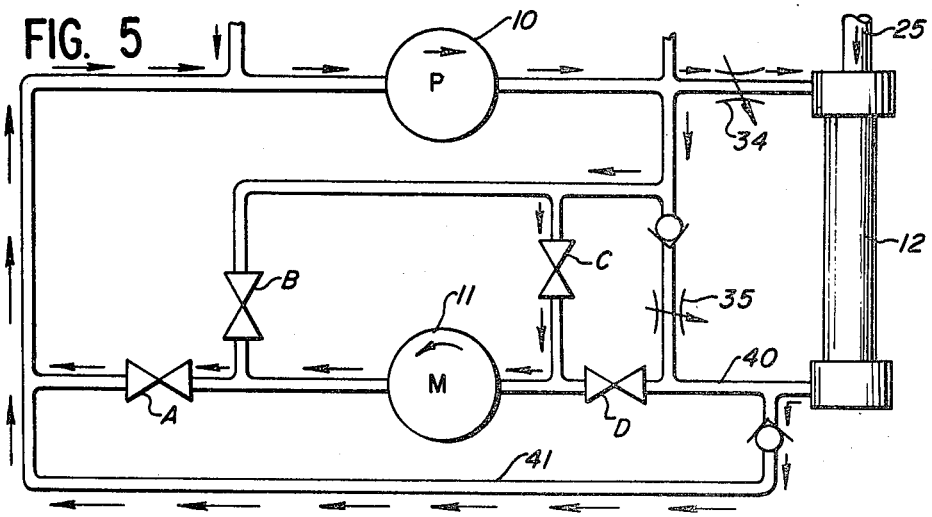
FIG. 5 is a diagram illustrating the direction of flow of hydraulic fluid when the control valves are set so that the tool element is rotated in the opposite direction and is simultaneously retracted.

In Mode III operation the fluid flow is as shown in FIG. 4 turning the motor 11 clockwise while retracting the tool. In Mode IV operation the fluid flow is as shown in FIG. 5, the tool retracting and the motor turning counterclockwise. As will be appreciated by those familiar with the art a means of freeing up a rotary cutting tool which is jammed and will not turn is provided by adjusting the control valves from the surface to first apply torque on the motor 10 in one direction and then in the other direction by alternately operating in Mode III and Mode IV. In this manner force to retract the tool is applied in both modes. A shift to Mode II subsequent to a number of cycles between Modes III and IV can free a cutting tool otherwise impossible to move.

The kind of cutting tool employed in some cases governs the mode of operation which can be employed. Cutters which are diamond faced can usually be driven in either direction without damage but cutters having edges such as are employed in ripsaws should usually not be driven backwards or tool damage will result. On the other hand tool damage is highly preferred over having to leave a sonde in a bore hole, and reverse driving can in some cases free up the tool so that it may be retracted into the sonde and withdrawn from the bore hole.

A fifth mode of operation can be achieved, if desired, by setting the function control valves in the positions indicated for Mode IV and reversing the direction of the pump 10. In this fifth mode the tool is driven clockwise but no force is applied to move the piston 25. Alternating between Mode IV and this fifth mode can be useful in some situations with particular cutting tools and is convenient since, as in Modes I and II no change in the function control valves need be made, only reversal of the direction of pump 10. Thus for Modes I and II operations and for Modes IV and V operation, the function control valves can be preset at the surface. Alternatively the apparatus need not have function control valves at all if appropriately piped.

A preferred embodiment of the invention has been described above however various changes and modifications such as will present themselves to those familiar with the art may be made without departing from the spirit of the invention whose scope is defined by the following claims.

I claim:

1. An hydraulic drive apparatus for use in downhole tools comprising:

(a) an electric motor driven positive displacement pump capable of being driven in either direction and controllable from the surface;

(b) an hydraulic motor connected by dual conduit means to said pump and adapted to be driven thereby;

(c) a cutting tool element capable of rotational and translational movement and connected to said hydraulic motor so as to be rotationally drive thereby;

(d) an hydraulic piston interconnected to said cutting tool element so as to impart translational movement thereto as said piston is moved;

(e) conduit means interconnecting the outlet of said hydraulic motor to said hydraulic piston at one end whereby advancing translational movement of said cutting tool element is imparted thereto at a rate which varies with the rate of rotational movement of said cutting tool;

(f) and check valve means in one of said dual conduit means for preventing the flow of hydraulic fluid from said pump to said hydraulic motor when said pump is driven in one direction and causing said fluid to exert force upon the opposite end of said hydraulic piston to effect retracting translational movement thereto retracting said cutting tool element.

2. The apparatus in accordance with claim 1 in which the one of the dual conduit means having a check valve therein also has a throttling valve for controlling the proportion of hydraulic fluid exiting the hydraulic motor which flows to the hydraulic piston when said check valve is open.

3. The apparatus in accordance with claim 1 in which a reservoir containing hydraulic fluid subject to bore hole pressure is provided for supplying make-up fluid to the pump, said reservoir being interconnected to both sides of said pump by conduit means, each of said conduit means having a pilot operated check valve therein responsive to pressure in the other of said conduit means and said pilot operated check valves thereby performing the dual function of supplying make-up fluid as required and of adjusting the pressure within said apparatus to bore hole pressure.

4. An hydraulic drive apparatus for use in downhole tools comprising:

(a) an electric motor driven pump;

(b) a positive displacement hydraulic motor connected by first conduit means to the inlet and outlet of said pump and adapted to be driven by said pump;

(c) a cutting tool element capable of rotational and translational movement and connected to said hydraulic motor so as to be rotationally driven thereby;

(d) an hydraulic cylinder having a piston interconnected to said cutting tool element so as to impart translational movement thereto as said piston is moved; a second conduit means interconnecting the outlet of said hydraulic motor to one side of said hydraulic cylinder whereby translational movement of said cutting tool element is imparted to said piston at a rate which varies with the rate of rotational movement of said cutting tool; and (e) a third conduit means interconnecting the other side of said hydraulic cylinder to the inlet of said pump, said third conduit means and the portion of said first conduit means connecting the outlet of said motor to said pump each being provided with a throttling valve for providing further control of movement of said piston.

* * * * *

UNITED STATES PATENT OFFICE

CERTIFICATE OF CORRECTION

Patent No. 4,431,064 Dated February 14, 1984

Inventor(s) Gary R. Bright

It is certified that error appears in the above-identified patent and that said Letters Patent are hereby corrected as shown below:

Column 1, line 21, "damage of destruction" should be --damage or destruction--.

Column 1, line 52, "ineffective" should be --ineffective,--.

Column 2, line 16, "drive" should be --driven--.

Column 3, line 36, "sides" should be --side--.

Column 4, line 8, "even" should be --event--.

Column 6, line 24, "drive" should be --driven--.

Signed and Sealed this

Fifteenth Day of May 1984

[SEAL]

Attest:

GERALD J. MOSSINGHOFF

Attesting Officer

Commissioner of Patents and Trademarks